US009008329B1

(12) United States Patent
Mandel et al.

(10) Patent No.: US 9,008,329 B1
(45) Date of Patent: Apr. 14, 2015

(54) NOISE REDUCTION USING MULTI-FEATURE CLUSTER TRACKER

(75) Inventors: Michael Mandel, San Francisco, CA (US); Carlos Avendano, Campbell, CA (US)

(73) Assignee: Audience, Inc., Mountain View, CA (US)

( * ) Notice: Subject to any disclaimer, the term of this patent is extended or adjusted under 35 U.S.C. 154(b) by 0 days.

(21) Appl. No.: 13/492,780

(22) Filed: Jun. 8, 2012

Related U.S. Application Data

(60) Provisional application No. 61/495,344, filed on Jun. 9, 2011.

(51) Int. Cl.
*G10K 11/16* (2006.01)
*G10K 15/00* (2006.01)

(52) U.S. Cl.
CPC ..... *G10K 15/00* (2013.01)

(58) Field of Classification Search
CPC ... G10L 15/142; G10L 19/10; G10L 21/0208; G10L 19/0204; G10L 25/93
USPC ..... 381/71.1–71.14, 94.1–94.9; 704/223, 704/221, 226, 206, 236, 255
See application file for complete search history.

(56) References Cited

U.S. PATENT DOCUMENTS

| | | | |
|---|---|---|---|
| 3,976,863 | A | 8/1976 | Engel |
| 3,978,287 | A | 8/1976 | Fletcher et al. |
| 4,137,510 | A | 1/1979 | Iwahara |
| 4,433,604 | A | 2/1984 | Ott |
| 4,516,259 | A | 5/1985 | Yato et al. |
| 4,535,473 | A | 8/1985 | Sakata |
| 4,536,844 | A | 8/1985 | Lyon |
| 4,581,758 | A | 4/1986 | Coker et al. |
| 4,628,529 | A | 12/1986 | Borth et al. |

(Continued)

FOREIGN PATENT DOCUMENTS

| | | |
|---|---|---|
| JP | 62110349 | 5/1987 |
| JP | 4184400 | 7/1992 |

(Continued)

OTHER PUBLICATIONS

Fazel et al, An overview of statistical pattern recognition techniques for speaker verification,IEEE, May 2011.*

(Continued)

*Primary Examiner* — Davetta W Goins
(74) *Attorney, Agent, or Firm* — Carr & Ferrell LLP

(57) ABSTRACT

Provided are methods and systems for noise suppression within multiple time-frequency points of spectral representations. A multi-feature cluster tracker is used to track signal and noise sources and to predict signal versus noise dominance at each time-frequency point. Multiple features, such as binaural and monaural features, may be used for these purposes. A Gaussian mixture model (GMM) is developed and, in some embodiments, dynamically updated for distinguishing signal from noise and performing mask-based noise reduction. Each frequency band may use a different GMM or share a GMM with other frequency bands. A GMM may be combined from two models, with one trained to model time-frequency points in which the target dominates and another trained to model time-frequency points in which the noise dominates. Dynamic updates of a GMM may be performed using an expectation-maximization algorithm in an unsupervised fashion.

22 Claims, 9 Drawing Sheets

(56) References Cited

U.S. PATENT DOCUMENTS 4,630,304 A 12/1986 Borth et al.
4,649,505 A 3/1987 Zinser, Jr. et al.
4,658,426 A 4/1987 Chabries et al.
4,674,125 A 6/1987 Carlson et al.
4,718,104 A 1/1988 Anderson
4,811,404 A 3/1989 Vilmur et al.
4,812,996 A 3/1989 Stubbs
4,864,620 A 9/1989 Bialick
4,920,508 A 4/1990 Yassaie et al.
5,027,410 A 6/1991 Williamson et al.
5,054,085 A 10/1991 Meisel et al.
5,058,419 A 10/1991 Nordstrom et al.
5,099,738 A 3/1992 Hotz
5,119,711 A 6/1992 Bell et al.
5,142,961 A 9/1992 Paroutaud
5,150,413 A 9/1992 Nakatani et al.
5,175,769 A 12/1992 Hejna, Jr. et al.
5,187,776 A 2/1993 Yanker
5,208,864 A 5/1993 Kaneda
5,210,366 A 5/1993 Sykes, Jr.
5,224,170 A 6/1993 Waite, Jr.
5,230,022 A 7/1993 Sakata
5,319,736 A 6/1994 Hunt
5,323,459 A 6/1994 Hirano
5,341,432 A 8/1994 Suzuki et al.
5,381,473 A 1/1995 Andrea et al.
5,381,512 A 1/1995 Holton et al.
5,400,409 A 3/1995 Linhard
5,402,493 A 3/1995 Goldstein
5,402,496 A 3/1995 Soli et al.
5,471,195 A 11/1995 Rickman
5,473,702 A 12/1995 Yoshida et al.
5,473,759 A 12/1995 Slaney et al.
5,479,564 A 12/1995 Vogten et al.
5,502,663 A 3/1996 Lyon
5,544,250 A 8/1996 Urbanski
5,574,824 A 11/1996 Slyh et al.
5,583,784 A 12/1996 Kapust et al.
5,587,998 A 12/1996 Velardo, Jr. et al.
5,590,241 A 12/1996 Park et al.
5,602,962 A 2/1997 Kellermann
5,675,778 A 10/1997 Jones
5,682,463 A 10/1997 Allen et al.
5,694,474 A 12/1997 Ngo et al.
5,706,395 A 1/1998 Arslan et al.
5,717,829 A 2/1998 Takagi
5,729,612 A 3/1998 Abel et al.
5,732,189 A 3/1998 Johnston et al.
5,749,064 A 5/1998 Pawate et al.
5,757,937 A 5/1998 Itoh et al.
5,792,971 A 8/1998 Timis et al.
5,796,819 A 8/1998 Romesburg
5,806,025 A 9/1998 Vis et al.
5,809,463 A 9/1998 Gupta et al.
5,825,320 A 10/1998 Miyamori et al.
5,839,101 A 11/1998 Vahatalo et al.
5,920,840 A 7/1999 Satyamurti et al.
5,933,495 A 8/1999 Oh
5,943,429 A 8/1999 Handel
5,956,674 A 9/1999 Smyth et al.
5,974,380 A 10/1999 Smyth et al.
5,978,824 A 11/1999 Ikeda
5,983,139 A 11/1999 Zierhofer
5,990,405 A 11/1999 Auten et al.
6,002,776 A 12/1999 Bhadkamkar et al.
6,061,456 A 5/2000 Andrea et al.
6,072,881 A 6/2000 Linder
6,097,820 A 8/2000 Turner
6,108,626 A 8/2000 Cellario et al.
6,122,610 A 9/2000 Isabelle
6,134,524 A 10/2000 Peters et al.
6,137,349 A 10/2000 Menkhoff et al.
6,140,809 A 10/2000 Doi
6,173,255 B1 1/2001 Wilson et al.
6,180,273 B1 1/2001 Okamoto
6,216,103 B1 4/2001 Wu et al.
6,222,927 B1 4/2001 Feng et al.
6,223,090 B1 4/2001 Brungart
6,226,616 B1 5/2001 You et al.
6,263,307 B1 7/2001 Arslan et al.
6,266,633 B1 7/2001 Higgins et al.
6,317,501 B1 11/2001 Matsuo
6,339,758 B1 1/2002 Kanazawa et al.
6,343,267 B1 * 1/2002 Kuhn et al. ..... 704/222
6,355,869 B1 3/2002 Mitton
6,363,345 B1 3/2002 Marash et al.
6,381,570 B2 4/2002 Li et al.
6,430,295 B1 8/2002 Handel et al.
6,434,417 B1 8/2002 Lovett
6,449,586 B1 9/2002 Hoshuyama
6,469,732 B1 10/2002 Chang et al.
6,487,257 B1 11/2002 Gustafsson et al.
6,496,795 B1 12/2002 Malvar
6,513,004 B1 1/2003 Rigazio et al.
6,516,066 B2 2/2003 Hayashi
6,529,606 B1 3/2003 Jackson, Jr. II et al.
6,549,630 B1 4/2003 Bobisuthi
6,584,203 B2 6/2003 Elko et al.
6,622,030 B1 9/2003 Romesburg et al.
6,717,991 B1 4/2004 Gustafsson et al.
6,718,309 B1 4/2004 Selly
6,738,482 B1 5/2004 Jaber
6,760,450 B2 7/2004 Matsuo
6,785,381 B2 8/2004 Gartner et al.
6,792,118 B2 9/2004 Watts
6,795,558 B2 9/2004 Matsuo
6,798,886 B1 9/2004 Smith et al.
6,810,273 B1 10/2004 Mattila et al.
6,882,736 B2 4/2005 Dickel et al.
6,915,264 B2 7/2005 Baumgarte
6,917,688 B2 7/2005 Yu et al.
6,944,510 B1 9/2005 Ballesty et al.
6,978,159 B2 12/2005 Feng et al.
6,982,377 B2 1/2006 Sakurai et al.
6,999,582 B1 2/2006 Popovic et al.
7,016,507 B1 3/2006 Brennan
7,020,605 B2 3/2006 Gao
7,031,478 B2 4/2006 Belt et al.
7,054,452 B2 5/2006 Ukita
7,065,485 B1 6/2006 Chong-White et al.
7,072,834 B2 * 7/2006 Zhou ..... 704/244
7,076,315 B1 7/2006 Watts
7,092,529 B2 8/2006 Yu et al.
7,092,882 B2 8/2006 Arrowood et al.
7,099,821 B2 8/2006 Visser et al.
7,142,677 B2 11/2006 Gonopolskiy et al.
7,146,316 B2 12/2006 Alves
7,155,019 B2 12/2006 Hou
7,164,620 B2 1/2007 Hoshuyama
7,171,008 B2 1/2007 Elko
7,171,246 B2 1/2007 Mattila et al.
7,174,022 B1 2/2007 Zhang et al.
7,206,418 B2 4/2007 Yang et al.
7,209,567 B1 4/2007 Kozel et al.
7,225,001 B1 5/2007 Eriksson et al.
7,242,762 B2 7/2007 He et al.
7,246,058 B2 7/2007 Burnett
7,254,242 B2 8/2007 Ise et al.
7,359,520 B2 4/2008 Brennan et al.
7,412,379 B2 8/2008 Taori et al.
7,433,907 B2 10/2008 Nagai et al.
7,555,075 B2 6/2009 Pessoa et al.
7,555,434 B2 6/2009 Nomura et al.
7,617,099 B2 11/2009 Yang et al.
7,664,640 B2 * 2/2010 Webber ..... 704/243
7,949,522 B2 5/2011 Hetherington et al.
8,098,812 B2 1/2012 Fadili et al.
8,363,850 B2 * 1/2013 Amada ..... 381/94.7
2001/0016020 A1 8/2001 Gustafsson et al.
2001/0031053 A1 10/2001 Feng et al.
2001/0038699 A1 11/2001 Hou
2002/0002455 A1 1/2002 Accardi et al.
2002/0009203 A1 1/2002 Erten
2002/0041693 A1 4/2002 Matsuo

(56) References Cited

U.S. PATENT DOCUMENTS

| | | | | |
|---|---|---|---|---|
| 2002/0080980 | A1 | 6/2002 | Matsuo | |
| 2002/0106092 | A1 | 8/2002 | Matsuo | |
| 2002/0116187 | A1 | 8/2002 | Erten | |
| 2002/0133334 | A1 | 9/2002 | Coorman et al. | |
| 2002/0147595 | A1 | 10/2002 | Baumgarte | |
| 2002/0184013 | A1 | 12/2002 | Walker | |
| 2003/0014248 | A1 | 1/2003 | Vetter | |
| 2003/0026437 | A1 | 2/2003 | Janse et al. | |
| 2003/0033140 | A1 | 2/2003 | Taori et al. | |
| 2003/0039369 | A1 | 2/2003 | Bullen | |
| 2003/0040908 | A1 | 2/2003 | Yang et al. | |
| 2003/0061032 | A1 | 3/2003 | Gonopolskiy | |
| 2003/0063759 | A1 | 4/2003 | Brennan et al. | |
| 2003/0072382 | A1 | 4/2003 | Raleigh et al. | |
| 2003/0072460 | A1 | 4/2003 | Gonopolskiy et al. | |
| 2003/0095667 | A1 | 5/2003 | Watts | |
| 2003/0099345 | A1 | 5/2003 | Gartner et al. | |
| 2003/0101048 | A1 | 5/2003 | Liu | |
| 2003/0103632 | A1 | 6/2003 | Goubran et al. | |
| 2003/0128851 | A1 | 7/2003 | Furuta | |
| 2003/0138116 | A1 | 7/2003 | Jones et al. | |
| 2003/0147538 | A1 | 8/2003 | Elko | |
| 2003/0169891 | A1 | 9/2003 | Ryan et al. | |
| 2003/0228023 | A1 | 12/2003 | Burnett et al. | |
| 2004/0013276 | A1 | 1/2004 | Ellis et al. | |
| 2004/0047464 | A1 | 3/2004 | Yu et al. | |
| 2004/0057574 | A1 | 3/2004 | Faller | |
| 2004/0078199 | A1 | 4/2004 | Kremer et al. | |
| 2004/0131178 | A1 | 7/2004 | Shahaf et al. | |
| 2004/0133421 | A1 | 7/2004 | Burnett et al. | |
| 2004/0165736 | A1 | 8/2004 | Hetherington et al. | |
| 2004/0196989 | A1 | 10/2004 | Friedman et al. | |
| 2004/0263636 | A1 | 12/2004 | Cutler et al. | |
| 2005/0025263 | A1 | 2/2005 | Wu | |
| 2005/0027520 | A1 | 2/2005 | Mattila et al. | |
| 2005/0049864 | A1 | 3/2005 | Kaltenmeier et al. | |
| 2005/0060142 | A1 | 3/2005 | Visser et al. | |
| 2005/0152559 | A1 | 7/2005 | Gierl et al. | |
| 2005/0185813 | A1 | 8/2005 | Sinclair et al. | |
| 2005/0213778 | A1 | 9/2005 | Buck et al. | |
| 2005/0216259 | A1 | 9/2005 | Watts | |
| 2005/0228518 | A1 | 10/2005 | Watts | |
| 2005/0238238 | A1* | 10/2005 | Xu et al. | 382/224 |
| 2005/0276423 | A1 | 12/2005 | Aubauer et al. | |
| 2005/0288923 | A1 | 12/2005 | Kok | |
| 2006/0072768 | A1 | 4/2006 | Schwartz et al. | |
| 2006/0074646 | A1 | 4/2006 | Alves et al. | |
| 2006/0098809 | A1 | 5/2006 | Nongpiur et al. | |
| 2006/0120537 | A1 | 6/2006 | Burnett et al. | |
| 2006/0133621 | A1 | 6/2006 | Chen et al. | |
| 2006/0149535 | A1 | 7/2006 | Choi et al. | |
| 2006/0160581 | A1 | 7/2006 | Beaugeant et al. | |
| 2006/0165202 | A1* | 7/2006 | Thomas et al. | 375/368 |
| 2006/0184363 | A1 | 8/2006 | McCree et al. | |
| 2006/0198542 | A1 | 9/2006 | Benjelloun Touimi et al. | |
| 2006/0222184 | A1 | 10/2006 | Buck et al. | |
| 2007/0021958 | A1 | 1/2007 | Visser et al. | |
| 2007/0027685 | A1 | 2/2007 | Arakawa et al. | |
| 2007/0033020 | A1 | 2/2007 | (Kelleher) Francois et al. | |
| 2007/0067166 | A1 | 3/2007 | Pan et al. | |
| 2007/0078649 | A1 | 4/2007 | Hetherington et al. | |
| 2007/0094031 | A1 | 4/2007 | Chen | |
| 2007/0100612 | A1 | 5/2007 | Ekstrand et al. | |
| 2007/0116300 | A1 | 5/2007 | Chen | |
| 2007/0150268 | A1 | 6/2007 | Acero et al. | |
| 2007/0154031 | A1 | 7/2007 | Avendano et al. | |
| 2007/0165879 | A1 | 7/2007 | Deng et al. | |
| 2007/0195968 | A1 | 8/2007 | Jaber | |
| 2007/0230712 | A1 | 10/2007 | Belt et al. | |
| 2007/0276656 | A1 | 11/2007 | Solbach et al. | |
| 2008/0019548 | A1 | 1/2008 | Avendano | |
| 2008/0033723 | A1 | 2/2008 | Jang et al. | |
| 2008/0140391 | A1 | 6/2008 | Yen et al. | |
| 2008/0201138 | A1 | 8/2008 | Visser et al. | |
| 2008/0228478 | A1 | 9/2008 | Hetherington et al. | |
| 2008/0260175 | A1 | 10/2008 | Elko | |
| 2009/0012783 | A1 | 1/2009 | Klein | |
| 2009/0012786 | A1 | 1/2009 | Zhang et al. | |
| 2009/0129610 | A1 | 5/2009 | Kim et al. | |
| 2009/0220107 | A1 | 9/2009 | Every et al. | |
| 2009/0228272 | A1* | 9/2009 | Herbig et al. | 704/233 |
| 2009/0238373 | A1 | 9/2009 | Klein | |
| 2009/0253418 | A1 | 10/2009 | Makinen | |
| 2009/0271187 | A1 | 10/2009 | Yen et al. | |
| 2009/0296958 | A1 | 12/2009 | Sugiyama | |
| 2009/0323982 | A1* | 12/2009 | Solbach et al. | 381/94.3 |
| 2010/0094643 | A1 | 4/2010 | Avendano et al. | |
| 2010/0278352 | A1 | 11/2010 | Petit et al. | |
| 2010/0282045 | A1* | 11/2010 | Chen et al. | 84/612 |
| 2011/0178800 | A1 | 7/2011 | Watts | |
| 2011/0182436 | A1 | 7/2011 | Murgia et al. | |
| 2012/0093341 | A1* | 4/2012 | Kim et al. | 381/94.7 |
| 2012/0121096 | A1 | 5/2012 | Chen et al. | |
| 2012/0140917 | A1 | 6/2012 | Nicholson et al. | |
| 2012/0143363 | A1* | 6/2012 | Liu et al. | 700/94 |

FOREIGN PATENT DOCUMENTS

| | | |
|---|---|---|
| JP | 5053587 | 3/1993 |
| JP | 2005172865 | 7/1993 |
| JP | 6269083 | 9/1994 |
| JP | 10313497 | 11/1998 |
| JP | 11249693 | 9/1999 |
| JP | 2004053895 | 2/2004 |
| JP | 2004531767 | 10/2004 |
| JP | 2004533155 | 10/2004 |
| JP | 2005110127 | 4/2005 |
| JP | 2005148274 | 6/2005 |
| JP | 2005518118 | 6/2005 |
| JP | 2005195955 | 7/2005 |
| WO | 0174118 | 10/2001 |
| WO | 02080362 | 10/2002 |
| WO | 02103676 | 12/2002 |
| WO | 03043374 | 5/2003 |
| WO | 03069499 | 8/2003 |
| WO | 2004010415 | 1/2004 |
| WO | 2007081916 | 7/2007 |
| WO | 2007140003 | 12/2007 |
| WO | 2010005493 | 1/2010 |
| WO | 2011094232 | 8/2011 |

OTHER PUBLICATIONS

Sundaram et al, Discriminating two types of noise sources using cortical representation and dimension reduction technique, iee,2007.*

Bach et al, Learning Spectral Clustering with application to speech separation, Journal of machine learning research,2006.*

Tognieri et al, a comparison of the LBG,LVQ,MLP,SOM and GMM algorithms for vector quantisation and clustering analysis, 1992.*

Klautau et al, Discriminative Gaussian mixture models a comparison with kernel classifiers, ICML, 2003.*

Allen, Jont B. "Short Term Spectral Analysis, Synthesis, and Modification by Discrete Fourier Transform", IEEE Transactions on Acoustics, Speech, and Signal Processing. vol. ASSP-25, No. 3, Jun. 1977. pp. 235-238.

Allen, Jont B. et al. "A Unified Approach to Short-Time Fourier Analysis and Synthesis", Proceedings of the IEEE. vol. 65, No. 11, Nov. 1977. pp. 1558-1564.

Avendano, Carlos, "Frequency-Domain Source Identification and Manipulation in Stereo Mixes for Enhancement, Suppression and Re-Panning Applications," 2003 IEEE Workshop on Application of Signal Processing to Audio and Acoustics, Oct. 19-22, pp. 55-58, New Peitz, New York, USA.

Boll, Steven F. "Suppression of Acoustic Noise in Speech using Spectral Subtraction", IEEE Transactions on Acoustics, Speech and Signal Processing, vol. ASSP-27, No. 2, Apr. 1979, pp. 113-120.

Boll, Steven F. et al. "Suppression of Acoustic Noise in Speech Using Two Microphone Adaptive Noise Cancellation", IEEE Transactions on Acoustic, Speech, and Signal Processing, vol. ASSP-28, No. 6, Dec. 1980, pp. 752-753.

(56) References Cited

OTHER PUBLICATIONS

Boll, Steven F. "Suppression of Acoustic Noise in Speech Using Spectral Subtraction", Dept. of Computer Science, University of Utah Salt Lake City, Utah, Apr. 1979, pp. 18-19.
Chen, Jingdong et al. "New Insights into the Noise Reduction Wiener Filter", IEEE Transactions on Audio, Speech, and Language Processing. vol. 14, No. 4, Jul. 2006, pp. 1218-1234.
Cohen, Israel et al. "Microphone Array Post-Filtering for Non-Stationary Noise Suppression", IEEE International Conference on Acoustics, Speech, and Signal Processing, May 2002, pp. 1-4.
Cohen, Israel, "Multichannel Post-Filtering in Nonstationary Noise Environments", IEEE Transactions on Signal Processing, vol. 52, No. 5, May 2004, pp. 1149-1160.
Dahl, Mattias et al., "Simultaneous Echo Cancellation and Car Noise Suppression Employing a Microphone Array", 1997 IEEE International Conference on Acoustics, Speech, and Signal Processing, Apr. 21-24, pp. 239-242.
Elko, Gary W., "Chapter 2: Differential Microphone Arrays", "Audio Signal Processing for Next-Generation Multimedia Communication Systems", 2004, pp. 12-65, Kluwer Academic Publishers, Norwell, Massachusetts, USA.
"ENT 172." Instructional Module. Prince George's Community College Department of Engineering Technology. Accessed: Oct. 15, 2011. Subsection: "Polar and Rectangular Notation". <http://academic.ppgcc.edu/ent/ent172_instr_mod.html>.
Fuchs, Martin et al. "Noise Suppression for Automotive Applications Based on Directional Information", 2004 IEEE International Conference on Acoustics, Speech, and Signal Processing, May 17-21, pp. 237-240.
Fulghum, D. P. et al., "LPC Voice Digitizer with Background Noise Suppression", 1979 IEEE International Conference on Acoustics, Speech, and Signal Processing, pp. 220-223.
Goubran, R.A. "Acoustic Noise Suppression Using Regressive Adaptive Filtering", 1990 IEEE 40th Vehicular Technology Conference, May 6-9, pp. 48-53.
Graupe, Daniel et al., "Blind Adaptive Filtering of Speech from Noise of Unknown Spectrum Using a Virtual Feedback Configuration", IEEE Transactions on Speech and Audio Processing, Mar. 2000, vol. 8, No. 2, pp. 146-158.
Haykin, Simon et al. "Appendix A.2 Complex Numbers." Signals and Systems. 2nd Ed. 2003. p. 764.
Hermansky, Hynek "Should Recognizers Have Ears?", in Proc. ESCA Tutorial and Research Workshop on Robust Speech Recognition for Unknown Communication Channels, pp. 1-10, France 1997.
Hohmann, V. "Frequency Analysis and Synthesis Using a Gammatone Filterbank", ACTA Acustica United with Acustica, 2002, vol. 88, pp. 433-442.
Jeffress, Lloyd A. et al. "A Place Theory of Sound Localization," Journal of Comparative and Physiological Psychology, 1948, vol. 41, p. 35-39.
Jeong, Hyuk et al., "Implementation of a New Algorithm Using the STFT with Variable Frequency Resolution for the Time-Frequency Auditory Model", J. Audio Eng. Soc., Apr. 1999, vol. 47, No. 4., pp. 240-251.
Kates, James M. "A Time-Domain Digital Cochlear Model", IEEE Transactions on Signal Processing, Dec. 1991, vol. 39, No. 12, pp. 2573-2592.
Lazzaro, John et al., "A Silicon Model of Auditory Localization," Neural Computation Spring 1989, vol. 1, pp. 47-57, Massachusetts Institute of Technology.
Lippmann, Richard P. "Speech Recognition by Machines and Humans", Speech Communication, Jul. 1997, vol. 22, No. 1, pp. 1-15.
Liu, Chen et al. "A Two-Microphone Dual Delay-Line Approach for Extraction of a Speech Sound in the Presence of Multiple Interferers", Journal of the Acoustical Society of America, vol. 110, No. 6, Dec. 2001, pp. 3218-3231.
Martin, Rainer et al. "Combined Acoustic Echo Cancellation, Dereverberation and Noise Reduction: A two Microphone Approach", Annales des Telecommunications/Annals of Telecommunications. vol. 49, No. 7-8, Jul.-Aug. 1994, pp. 429-438.
Martin, Rainer "Spectral Subtraction Based on Minimum Statistics", in Proceedings Europe. Signal Processing Conf., 1994, pp. 1182-1185.
Mitra, Sanjit K. Digital Signal Processing: a Computer-based Approach. 2nd Ed. 2001. pp. 131-133.
Mizumachi, Mitsunori et al. "Noise Reduction by Paired-Microphones Using Spectral Subtraction", 1998 IEEE International Conference on Acoustics, Speech and Signal Processing, May 12-15. pp. 1001-1004.
Moonen, Marc et al. "Multi-Microphone Signal Enhancement Techniques for Noise Suppression and Dereverbration," http://www.esat.kuleuven.ac.be/sista/yearreport97//node37.html, accessed on Apr. 21, 1998.
Watts, Lloyd Narrative of Prior Disclosure of Audio Display on Feb. 15, 2000 and May 31, 2000.
Cosi, Piero et al. (1996), "Lyon's Auditory Model Inversion: a Tool for Sound Separation and Speech Enhancement," Proceedings of ESCA Workshop on 'The Auditory Basis of Speech Perception,' Keele University, Keele (UK), Jul. 15-19, 1996, pp. 194-197.
Parra, Lucas et al. "Convolutive Blind Separation of Non-Stationary Sources", IEEE Transactions on Speech and Audio Processing. vol. 8, No. 3, May 2008, pp. 320-327.
Rabiner, Lawrence R. et al. "Digital Processing of Speech Signals", (Prentice-Hall Series in Signal Processing). Upper Saddle River, NJ: Prentice Hall, 1978.
Weiss, Ron et al., "Estimating Single-Channel Source Separation Masks: Revelance Vector Machine Classifiers vs. Pitch-Based Masking", Workshop on Statistical and Perceptual Audio Processing, 2006.
Schimmel, Steven et al., "Coherent Envelope Detection for Modulation Filtering of Speech," 2005 IEEE International Conference on Acoustics, Speech, and Signal Processing, vol. 1, No. 7, pp. 221-224.
Slaney, Malcom, "Lyon's Cochlear Model", Advanced Technology Group, Apple Technical Report #13, Apple Computer, Inc., 1988, pp. 1-79.
Slaney, Malcom, et al. "Auditory Model Inversion for Sound Separation," 1994 IEEE International Conference on Acoustics, Speech and Signal Processing, Apr. 19-22, vol. 2, pp. 77-80.
Slaney, Malcom. "An Introduction to Auditory Model Inversion", Interval Technical Report IRC 1994-014, http://coweb.ecn.purdue.edu/~maclom/interval/1994-014/, Sep. 1994, accessed on Jul. 6, 2010.
Solbach, Ludger "An Architecture for Robust Partial Tracking and Onset Localization in Single Channel Audio Signal Mixes", Technical University Hamburg-Harburg, 1998.
Stahl, V. et al., "Quantile Based Noise Estimation for Spectral Subtraction and Wiener Filtering," 2000 IEEE International Conference on Acoustics, Speech, and Signal Processing, Jun. 5-9, vol. 3, pp. 1875-1878.
Syntrillium Software Corporation, "Cool Edit User's Manual", 1996, pp. 1-74.
Tashev, Ivan et al. "Microphone Array for Headset with Spatial Noise Suppressor", http://research.microsoft.com/users/ivantash/Documents/Tashev_MAforHeadset_HSCMA_05.pdf. (4 pages).
Tchorz, Jurgen et al., "SNR Estimation Based on Amplitude Modulation Analysis with Applications to Noise Suppression", IEEE Transactions on Speech and Audio Processing, vol. 11, No. 3, May 2003, pp. 184-192.
Valin, Jean-Marc et al. "Enhanced Robot Audition Based on Microphone Array Source Separation with Post-Filter", Proceedings of 2004 IEEE/RSJ International Conference on Intelligent Robots and Systems, Sep. 28-Oct. 2, 2004, Sendai, Japan. pp. 2123-2128.
Watts, Lloyd, "Robust Hearing Systems for Intelligent Machines," Applied Neurosystems Corporation, 2001, pp. 1-5.
Widrow, B. et al., "Adaptive Antenna Systems," Proceedings of the IEEE, vol. 55, No. 12, pp. 2143-2159, Dec. 1967.
Yoo, Heejong et al., "Continuous-Time Audio Noise Suppression and Real-Time Implementation", 2002 IEEE International Conference on Acoustics, Speech, and Signal Processing, May 13-17, pp. IV3980-IV3983.

(56) References Cited

OTHER PUBLICATIONS

International Search Report dated Jun. 8, 2001 in Application No. PCT/US01/08372.
International Search Report dated Apr. 3, 2003 in Application No. PCT/US02/36946.
International Search Report dated May 29, 2003 in Application No. PCT/US03/04124.
International Search Report and Written Opinion dated Oct. 19, 2007 in Application No. PCT/US07/00463.
International Search Report and Written Opinion dated Apr. 9, 2008 in Application No. PCT/US07/21654.
International Search Report and Written Opinion dated Sep. 16, 2008 in Application No. PCT/US07/12628.
International Search Report and Written Opinion dated Oct. 1, 2008 in Application No. PCT/US08/08249.
International Search Report and Written Opinion dated May 11, 2009 in Application No. PCT/US09/01667.
International Search Report and Written Opinion dated Aug. 27, 2009 in Application No. PCT/US09/03813.
International Search Report and Written Opinion dated May 20, 2010 in Application No. PCT/US09/06754.
Fast Cochlea Transform, US Trademark Reg. No. 2,875,755 (Aug. 17, 2004).
Dahl, Mattias et al., "Acoustic Echo and Noise Cancelling Using Microphone Arrays", International Symposium on Signal Processing and its Applications, ISSPA, Gold coast, Australia, Aug. 25-30, 1996, pp. 379-382.
Demol, M. et al. "Efficient Non-Uniform Time-Scaling of Speech With WSOLA for CALL Applications", Proceedings of InSTIL/ICALL2004—NLP and Speech Technologies in Advanced Language Learning Systems—Venice Jun. 17-19, 2004.
Laroche, Jean. "Time and Pitch Scale Modification of Audio Signals", in "Applications of Digital Signal Processing to Audio and Acoustics", The Kluwer International Series in Engineering and Computer Science, vol. 437, pp. 279-309, 2002.
Moulines, Eric et al., "Non-Parametric Techniques for Pitch-Scale and Time-Scale Modification of Speech", Speech Communication, vol. 16, pp. 175-205, 1995.
Verhelst, Werner, "Overlap-Add Methods for Time-Scaling of Speech", Speech Communication vol. 30, pp. 207-221, 2000.
International Search Report and Written Opinion dated Mar. 31, 2011 in Application No. PCT/US11/22462.

* cited by examiner

NOISE REDUCTION USING MULTI-FEATURE CLUSTER TRACKER

CROSS-REFERENCE TO RELATED APPLICATIONS

This application claims the benefit of U.S. Provisional Application No. 61/495,344, filed Jun. 9, 2011, which is incorporated herein by reference in its entirety. This application is related to U.S. patent application Ser. No. 12/693,998, filed Jan. 26, 2010, now U.S. Pat. No. 8,718,290, U.S. patent application Ser. No. 13/363,362, filed Jan. 31, 2012, and U.S. patent application Ser. No 13/396,568, filed Feb. 14, 2012, which are incorporated herein by reference in their entirety.

FIELD

This application relates generally to enhancing audio quality and more specifically to computer-implemented systems and methods for noise suppression within multiple time-frequency points of spectral representations using Gaussian mixture models.

BACKGROUND

Various methods and systems have been developed for reducing background noise in adverse audio environments in which a high level of noises is mixed with a signal. For example, stationary noise suppression techniques are used, in which an output level of noise is proportionally lower relative to the input noise level. Typically, the stationary noise suppression is in the range of 12-13 decibels (dB). The noise suppression is fixed to this conservative level in order to avoid creating undesirable speech distortion, which would be apparent for this technique with higher noise suppression.

In order to provide higher noise suppression, dynamic noise suppression systems based on signal-to-noise ratios (SNR) have been utilized. Unfortunately, SNR, by itself, is not a very good predictor of an amount of speech distortion because of the existence of different noise types in the audio environment and the non-stationary nature of a speech source (e.g., people). SNR is a ratio of how much louder speech is than noise. The SNR may be adversely impacted when speech energy (i.e., the signal) fluctuates over a period of time. The fluctuation of the speech energy can be caused by changes of intensity and sequences of words and pauses.

Additionally, stationary and dynamic noises may be present in the audio environment. The SNR averages all of these stationary and non-stationary noises and speech. There is no consideration as to the statistics of the noise signal; only to the overall level of noise.

In some prior art systems, a fixed classification threshold discrimination system may be used to assist in noise suppression. However, fixed classification systems are not robust. In one example, speech and non-speech elements may be classified based on fixed averages. However, if conditions change, such as when the speaker moves the microphone away from their mouth or noise suddenly gets louder, the fixed classification system will erroneously classify the speech and non-speech elements. As a result, speech elements may be suppressed and overall performance may significantly degrade.

SUMMARY

Provided are methods and systems for noise suppression within multiple time-frequency points of spectral representations. A multi-feature cluster tracker is used to track signal and noise sources and to predict signal-to-noise dominance at each time-frequency point. Multiple features, such as binaural and monaural features, are used for these purposes. A Gaussian mixture model (GMM) is developed and, in some embodiments, dynamically updated for distinguishing signal from noise and performing mask-based noise reduction. Each frequency band may use a different GMM or share a GMM with other frequency bands. A GMM may be combined from two models, one trained to model time-frequency points in which the target dominates and another trained to model time-frequency points in which the noise dominates. Alternatively, the GMM may be trained to maximize a likelihood function comprising discriminative and generative terms. Dynamic updates of a GMM may be performed using an expectation-maximization algorithm and in an unsupervised fashion.

In certain embodiments, a method for processing acoustic signals involves receiving a multichannel audio input corresponding to a plurality of audio channels and generating a spectral representation of the multichannel audio input. The method also involves extracting one or more acoustic features from the spectral representation and performing a linear transformation of the one or more acoustic features using a dimensionality reduction technique to generate lower dimensional data. The method then proceeds with classifying each time-frequency observation in the transformed data using a GMM to estimate a probability of speech dominance in the multichannel audio input.

In some embodiments, these acoustic features correspond to each individual channel of the plurality of audio channels. In the same or other embodiments, the acoustic features correspond to interactions between individual channels of the plurality of audio channels. Some examples of acoustic features include an interaural level difference (ILD), interaural phase difference (IPD), primary microphone energy, estimated pitch, and estimated pitch saliency.

In some embodiments, the dimensionality reduction technique involves a linear support vector machine. Learning the linear transformation may involve subtracting a data mean, whitening the data, generating a maximum margin hyperplane that separates speech points from noise points in the multichannel audio input, and projecting the speech points and the noise points onto the maximum margin hyperplane. Performing the linear transformation may be repeated on the null space of this hyperplane for each of multiple dimensions, which may be orthogonal and decorrelated.

In some embodiments, a different GMM is used for each frequency band of the multichannel audio input. The noise points and signal points may be identified in the multichannel audio input based on a probability of each data point determined with the GMM. The noise points and signal points are identified by further processing probabilities of data points determined using the GMM. This further processing may involve incorporating local contextual information.

In some embodiments, the method also involves updating the GMM based on the transformed data generated by linear transformation and repeating the classifying operation using the updated GMM. Repeating the classifying operation using the updated GMM may be performed on a new set of transformed data. Generating, extracting, performing, and classifying operations may be repeated upon receiving a new multichannel audio input to identify new noise points and new signal points. The same or different (e.g., updated) GMM may be used during the repeated classifying operation. In some embodiments, the method also involves generating a binary mask such as a post-filter mask or a canceller adaptation control mask based on the identified noise points and the identified signal points.

Provided also is a method of calibrating an apparatus for processing acoustic signals. The method may involve receiving a multichannel training audio input corresponding to a plurality of audio channels, generate a training spectral representation of the multichannel training audio input, and extracting one or more training acoustic features from the training spectral representation. The method then continues with performing a linear transformation of the one or more training acoustic features using a dimensionality reduction technique to generate training data, on which a GMM is trained Training of the GMM may involve an algorithm to optimize generative costs and discriminative costs.

Provided also is an apparatus for processing acoustic signals. The apparatus includes one or more microphones for receiving a multichannel audio input corresponding to a plurality of audio channels and an audio processing system for generating a spectral representation of the multichannel audio input and extracting one or more acoustic features from the spectral representation. The audio processing system may also perform a linear transformation of the one or more acoustic features using a dimensionality reduction technique to generate transformed data, classify each time-frequency observation in the transformed data using a multi-feature cluster tracker based on a GMM to identify noise points and signal points in the multichannel audio input, develop a mask for distinguishing the noise points and the signal points, and apply the mask to the multichannel audio input to generate a processed output. The multi-feature cluster tracker may be selected from the plurality of multi-feature cluster trackers based on a number of microphones and microphone spacing corresponding to the multichannel training audio input. The apparatus also includes an output device for transmitting the processed output.

DETAILED DESCRIPTION OF EXEMPLARY EMBODIMENTS

Introduction

Figure 1:
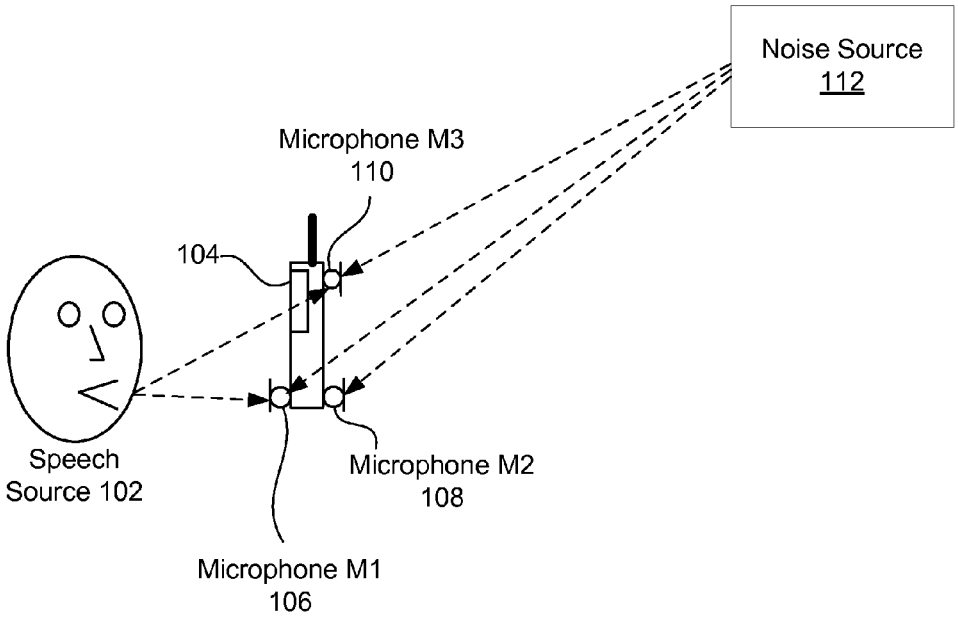
FIGS. 1 and 2 illustrate schematic representations of acoustic environments, in accordance with some embodiments.

Various noise suppression systems are designed to correctly distinguish audio input generated by one or more target speakers and surrounding noise. The ability to do this distinction correctly in every time-frequency point of a spectral representation allows a system to perform mask-based noise reduction in a more efficient manner. Multiple different features may be extracted from the same spectral representation to provide more detailed analysis and better distinction of the target and noise from this representation. The system may be trained using some prior data. In certain embodiments, the system may also adapt online to new data as the data comes in.

Provided suppression systems utilize multi-feature cluster trackers that are based on GMMs. The multi-feature cluster truckers are specifically design to provide accurate prediction of the 3 dB dominance mask, i.e. the probability that the target is 3 dB louder than the noise at a particular time-frequency point. Of course, other types of masks are also within the scope of this disclosure. The systems are used in two main processes, a training process used to develop the corresponding GMMs, and operating process in which these GMMs are used to provide, for example, dominance masks. The dominance masks are sometimes referred to as probabilistic masks and may be used to further develop various downstream masks, such as suppression and adaptation masks.

A brief description of a process example is presented to introduce and illustrate some of the features of the provided suppression systems. A received multichannel audio input is transformed into a spectral representation. Various features are extracted from this spectral representation, both from each channel individually and using the interactions between channels. Some examples of the extracted features include an interaural level difference, interaural phase difference, primary microphone energy, estimated pitch, and estimated pitch saliency.

The extracted features are then transformed using a dimensionality reduction technique, such as a linear transformation technique based on individual vectors generated using a linear support vector machine (SVM).

In exemplary embodiments, for learning the linear transformation, the data's mean is subtracted, and it is whitened using a principal components analysis (PCA). The SVM then learns the maximum margin hyperplane separating the speech points from the noise points in feature space. The data points, including the speech points and noise points are then projected onto the null space of this hyperplane projection, and the process is repeated until as many dimensions are extracted as desired. These dimensions are then orthogonal and decorrelated by design.

Then a GMM, which has been previously trained, is used to classify each time-frequency observation. A different GMM could be used in each frequency band, or multiple bands could share the same GMM. Each GMM may be constructed from two other GMMs, one trained to model time-frequency points in which the target dominates, and another trained to model time-frequency points in which the noise dominates. The GMMs could also be trained to maximize a combination of a discriminative and generative cost function to both describe the data and to discriminate between the two classes.

During this operating process, one or more previously developed GMMs may be used to classify new data corresponding to audio input. In certain embodiments, these one or more GMMs are updated according to the data that they process. As such, GMMs can be updated in an unsupervised fashion or, if external supervision information is available, then that information may be incorporated into the updates. These updates need not happen after every observation. The updates can reflect both the data that has recently been seen and the training data collected ahead of time in the form of a prior distribution over the Gaussians' parameters. To perform online adaptation of the GMM, an online Expectation Maximization (EM) algorithm may be used.

The final classification decision may be based on the probability of each observation under the GMM. Alternatively, the probabilities provided by the GMM may be further processed to predict whether each time-frequency point is target or noise. This further processing could take the form of interpreting local contextual information in the probabilities or other external quantities.

As explained above, the multi-feature cluster tracker may be configured to track one or more target sources and one or more noise sources and to predict the probability that the target speech is dominant over the noise at each time-frequency point. Multiple features, both binaural and monaural, may be used for these purposes. The multi-feature cluster tracker accepts as input any set of features calculated at the frame level and uses these features to predict the probability that target speech is dominant over noise, for example, by at least 3 dB at each time-frequency point. The multi-feature cluster tracker may be trained in an offline calibration for each scenario so that the multi-feature cluster tracker has reasonable limits of each feature for target and noise that are later used for tracking these sources online within these bounds.

The system may be used in various types of conditions, such as a close talk, far talk, close microphones, and spread microphones. The multi-feature cluster tracker is designed to work with any number of microphones, e.g., one, two, and three microphone inputs. Adaptation to inputs with other numbers of microphones may include a manual selection of a new feature set.

Described multi-feature cluster trackers may use multiple different types of acoustic features, such as interaural level difference, interaural phase difference, primary microphone energy, estimated pitch, and estimated pitch saliency. These multi-feature capabilities allow easier scaling to multiple microphone schemes and take advantage of new types of features.

The multi-feature cluster trackers are based on a GMM used for classification. A separate model may be run for the audio signal in each tap. Supervised offline training may be used to generate the prior distribution for the GMM and to initialize it. During operation, a multi-feature cluster tracker applies this trained GMM in an unsupervised mode to adapt to changing feature distributions. In certain embodiments, adaption of the GMM may be turned off during operation, and the previously trained GMM is used for classification without any change to this model.

Extractions of acoustic features from spectral representations are performed by an extractor module or simply an extractor, which may be specifically developed to extract features of particular types. Some examples of these features include interaural level difference, interaural phase difference, primary microphone energy, estimated pitch, and estimated pitch saliency. Other features may be used as well. The system may be configured to use various combinations of the available features based on certain predetermined criteria.

Examples of Audio Environments

FIG. 1 illustrates a schematic representation of an audio environment, in accordance with certain embodiments. A user may act as a speech source 102 to an audio device 104. In other embodiments, audio device 104 may receive an audio input from another audio device. For example, in a teleconference setting, either one of the audio devices or some other intermediate device may be used for processing acoustic signals. In general, a device capturing acoustic signals may be the same as a device processing these acoustic signals, or two separate devices may be used for these functions.

In some embodiments, audio device 104 includes a microphone array having microphones 106, 108, and 110. The microphone array may include a close microphone array with microphones 106 and 108 and a spread microphone array with microphones 110 and either microphone 106 or 108. One or more of microphones 106, 108, and 110 may be implemented as omni-directional microphones. Microphones 106, 108, and 110 can be place at any distance with respect to each other (such as, for example, between 2 centimeters and 20 centimeters from each other).

Microphones 106, 108, and 110 may receive sound (i.e., acoustic signals) from the speech source 102 and noise source 112. Although noise source 112 is shown as a single location in FIG. 1, multiple noise sources may be presented in different locations. Noise sources may produce reverberations and echoes. Noise source 112 may be stationary, non-stationary (time- and/or frequency-varying), or a combination of both stationary and non-stationary noise sources. Noise source variations may be best explained with an example, such as a person or a group of people using a speakerphone function of a telephone while being in a conference room. Some examples of stationary noises may be fans and ventilation, while examples of non-stationary noises may be a moving cart, typing, outside cars, and the like. Speech sources may be all people present in the conference or a selected sub-group. As one can see, in addition to noise and speech sources being stationary or not, a speech source may switch to a noise source (e.g., a speaker starts typing or having a side conversation) and vice versa.

Figure 2:
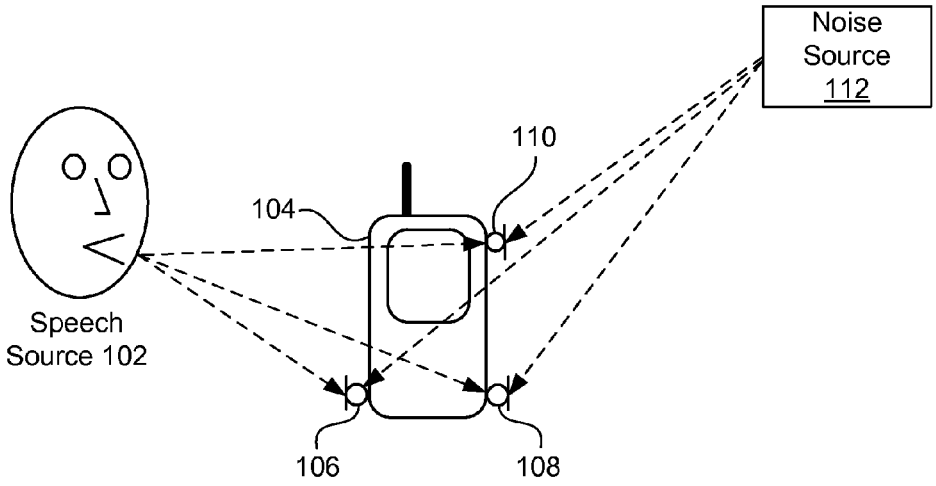

The positions of microphones 106, 108, and 110 on audio device 104 may vary. For example in FIG. 1, microphone 110 is located on the upper backside of audio device 104, and microphones 106 and 108 are located in line on the lower front and lower back of audio device 104. In the embodiment of FIG. 2, microphone 110 is positioned on an upper side of audio device 104 and microphones 106 and 108 are located on lower sides of the audio device.

Microphones 106, 108, and 110 are labeled as M1, M2, and M3, respectively. Though microphones M1 and M2 may be illustrated as spaced closer to each other, and microphone M3 may be spaced further apart from microphones M1 and M2, any microphone signal combination can be processed to achieve noise cancellation and determine level cues between two audio signals. The designations of M1, M2, and M3 are arbitrary with microphones 106, 108 and 110 in that any of microphones 106, 108 and 110 may be M1, M2, and M3.

The three microphones illustrated in FIGS. 1 and 2 represent just one example. The present technology may be implemented using any number of microphones, such as for example one, two, three, four, five, six, seven, eight, nine, ten or even more microphones. In embodiments with two or more microphones, signals can be processed as discussed in more detail below, wherein the signals can be associated with pairs of microphones, and wherein each pair may have different microphones or may share one or more microphones.

Examples of Audio Devices

Figure 3:
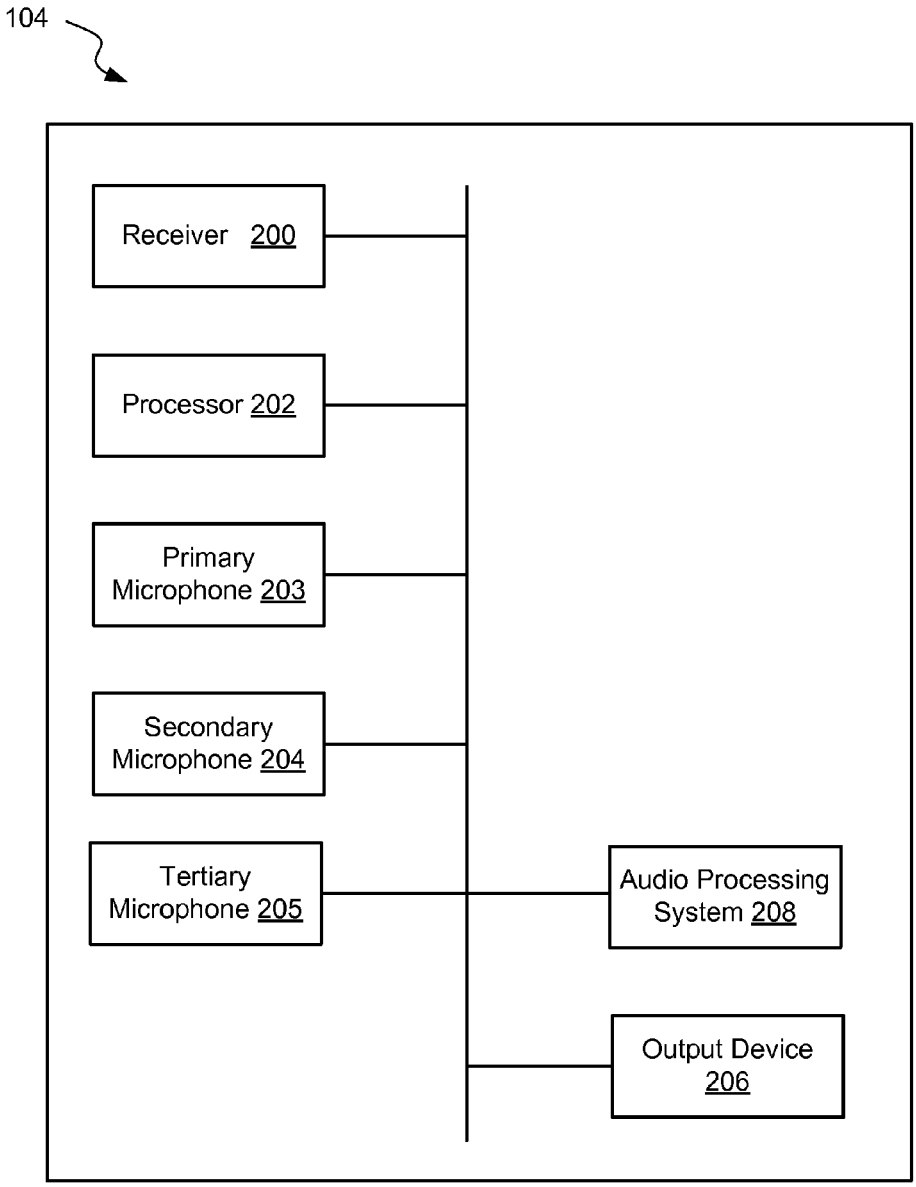
FIG. 3 illustrates a block diagram of an audio device, in accordance with certain embodiments.

FIG. 3 illustrates a block diagram of audio device 104, in accordance with certain embodiments. Audio device 104 may be an audio receiving device that includes a receiver 200, processor 202, primary microphone 203, secondary microphone 204, tertiary microphone 205, audio processing system 208, and output device 206. Other components may be present as well, such as computer readable memory. Some of these components are further described below with reference to FIG. 8. Audio device 104 may include fewer components than shown in FIG. 3. For example, an audio device may include only one or two microphones, or may include three or more microphones. In the same or other embodiments, the receiver may be replaced with a communication module.

Processor 202 may include hardware and software, which implements various functions described below. In certain embodiments, processor 202 is configured to operate as audio processing system 208. That is, processor 202 is specifically programmed for generating a spectral representation of the multichannel audio input, extracting one or more acoustic features from the spectral representation, performing linear transformation of the one or more acoustic features using a dimensionality reduction technique to generate a transformed data, classifying each time-frequency observation in the transformed data using a GMM to identify noise points and signal points in the multichannel audio input, developing a mask for distinguishing the noise points and the signal points, and applying the mask to the multichannel audio input to generate a processed output.

Receiver 200 may be an acoustic sensor configured to receive a signal from a (communication) network. In some embodiments, receiver 200 includes an antenna device. The signal may then be forwarded to audio processing system 208 and then to output device 206. Audio processing system 208 may be configured to receive the acoustic signals from an acoustic source via one or more microphones (e.g., primary microphone 203, secondary microphone 204, and tertiary microphone 205). Sometimes these microphones are referred to as primary, secondary, and tertiary acoustic sensors. For simplicity, secondary microphone 204 and tertiary microphone 205 are collectively (and interchangeably) referred to as secondary microphones in this document.

Primary microphone 203, secondary microphone 204, and tertiary microphone 205 may be spaced a distance apart in order to allow for an energy level difference between them. After reception by microphones 203-205, the acoustic signals may be converted into electric signals (i.e., a primary electric signal, a secondary electric signal, and a tertiary electrical signal). The electric signals may themselves be converted by an analog-to-digital converter (not shown) into digital signals for processing in accordance with some embodiments. In order to differentiate the acoustic signals, the acoustic signal received by primary microphone 203 is herein referred to as the primary acoustic signal, while the acoustic signal received by secondary microphone 204 is herein referred to as the secondary acoustic signal. The acoustic signal received by tertiary microphone 205 is herein referred to as the tertiary acoustic signal. In some embodiments, the acoustic signals from multiple microphones are used for improved noise cancellation as discussed further below. The primary acoustic signal, secondary acoustic signal, and tertiary acoustic signal may be processed by audio processing engine 208 to produce a signal with improved cancellation of noise components for transmission across a communications network.

Output device 206 may be any device which provides an audio output to a listener (e.g., an acoustic source). For example, output device 206 may be a speaker, an earpiece of a headset, or handset of audio device 104. In some embodiments, audio output is not converted into an acoustic signal at audio device 104 but instead is transmitted to another device. In these embodiments, output device 206 may be a transmitter (e.g., a computer network transmitter (wired or wireless), cellular network transmitter, radio transmitter, and the like).

In some embodiments, primary, secondary, and tertiary microphones 203-205 are omni-directional microphones. When these microphones are closely-spaced (e.g., 1-2 centimeters apart), a beamforming technique may be used to simulate a forward-facing and a backward-facing directional microphone response. A level difference may be obtained using a simulated forward-facing and a backward-facing directional microphone. The level difference may be used to discriminate speech and noise in the time-frequency domain, which can be used in noise cancellation.

Some or all of the components illustrated in FIG. 3 and described above may include instructions that are stored on a storage medium. The instructions can be retrieved and executed by processor 202. Some examples of instructions include software, program code, and firmware. Some examples of storage medium include memory devices and integrated circuits. The instructions are operational when executed by processor 202.

Either audio processing system 208, or processor 202 configured to perform noise suppression operations, is used to distinguish an audio input component corresponding to one or more speech sources from components corresponding to various noise sources. The ability to do this in every time-frequency point of a spectral representation allows a system to learn a model of the signal and noise and to perform mask-based noise reduction.

Audio processing system 208 is able to process information in the form of different features extracted from the spectral representation. It uses a GMM-based classifier and tracker. Input multi-channel audio is transformed into a spectral representation, and various features are extracted from it, both from each channel individually and using the interactions between channels. In one embodiment, the features extracted are one or more of the interaural level difference, interaural phase difference, energy at the primary microphone, estimated pitch, and estimated saliency of the pitch. Then, a GMM, which has been previously trained in certain embodiments, is used to classify each time-frequency observation. A different GMM could be used in each frequency band, or multiple bands could share GMMs. Each GMM could be constructed from two other GMMs, with one trained to model time-frequency points in which the target dominates, and another trained to model time-frequency points in which the noise dominates. These GMMs are used to classify new data, and can be updated according to the data that they see. They can be updated in an unsupervised fashion or, if external supervision information is available, that information can be incorporated into the updates. These updates need not happen after every observation. The updates can reflect both the data that has recently been seen and the training data collected ahead of time in the form of a prior distribution over the Gaussians' parameters. To perform an online adaptation of the GMM, an online EM algorithm can be used. The final classification decision is based on the probability of each observation under the Gaussians designated to model the target. Alternatively, a classifier could be trained to predict the class from the probability of a point under all of the Gaussians.

Examples of Audio Processing Systems

Figure 4:
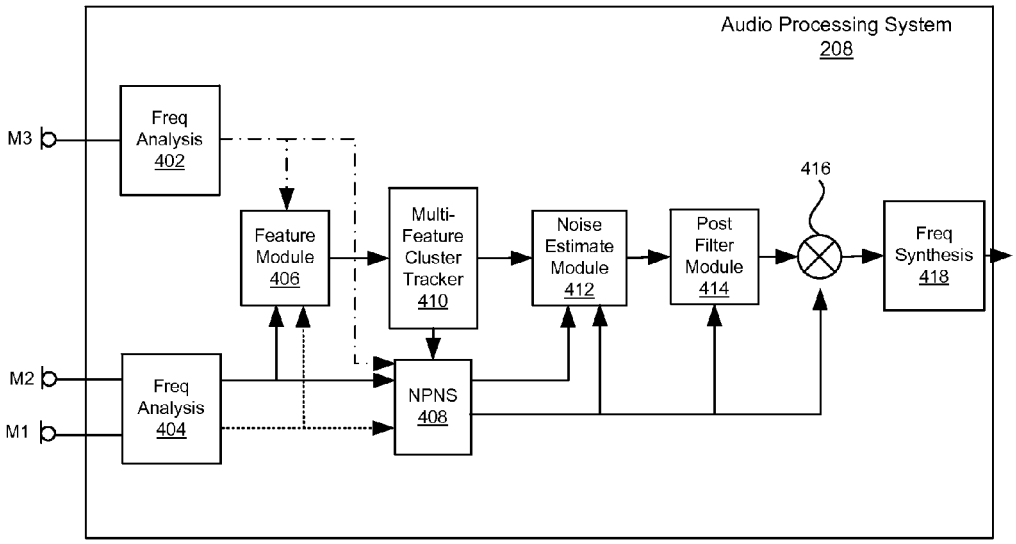
FIG. 4 illustrates a block diagram of an audio processing system, in accordance with certain embodiments.

FIG. 4 illustrates a block diagram of audio processing system 208, in accordance with certain embodiments. As explained above, audio processing system 208 may be one component of audio device 104 (e.g., embodied within a memory of audio device 104). Audio processing system 208 may include frequency analysis modules 402 and 404, feature module 406, Null-Processing Noise Subtraction (NPNS) module 408, multi-feature cluster tracker 410, noise estimate module 412, post filter module 414, multiplier component 416, and frequency synthesis module 418. Other modules and components may be used as well. Audio processing system 208 may include more or fewer modules and components than illustrated in FIG. 4, and the functionality of modules may be combined or expanded into fewer or additional modules. Example communication lines are illustrated between various modules illustrated in FIG. 4. The lines of communication are not intended to limit which modules are communicatively coupled with others. Moreover, the visual indication of a line (e.g., dashed, doted, alternate dash and dot) is not intended to indicate a particular communication, but rather to aid in visual presentation of the system.

In operation, acoustic signals are received by microphones M1, M2 and M3, converted to electric signals, and then the electric signals are processed through frequency analysis modules 402 and 404. In one embodiment, frequency analysis module 402 takes the acoustic signals and mimics the frequency analysis of the cochlea (i.e., cochlear domain) simulated by a filter bank. Frequency analysis module 402 may separate the acoustic signals into frequency sub-bands. A sub-band is the result of a filtering operation on an input signal where the bandwidth of the filter is narrower than the bandwidth of the signal received by frequency analysis module 402. Alternatively, other filters such as short-time Fourier transform (STFT), sub-band filter banks, modulated complex lapped transforms, cochlear models, wavelets, and so forth, can be used for the frequency analysis and synthesis. Because most sounds (e.g., acoustic signals) are complex and comprise more than one frequency, a sub-band analysis on the acoustic signal determines which individual frequencies are present in the complex acoustic signal during a frame (e.g., a predetermined period of time). For example, the length of a frame may be 4 ms, 8 ms, or some other length of time. In some embodiments there may be no frame at all. The results may comprise sub-band signals in a fast cochlea transform (FCT) domain.

The sub-band frame signals are provided from frequency analysis modules 402 and 404 to feature module 406 and NPNS module 408. NPNS module 408 may adaptively subtract out a noise component from a primary acoustic signal for each sub-band. As such, the output of NPNS 408 includes sub-band estimates of the noise in the primary signal and sub-band estimates of the speech (in the form of a noise-subtracted sub-band signals) or other desired audio in the in the primary signal. The NPNS module is described further in U.S. patent application Ser. No. 12/693,998, incorporated by reference herein.

Sub-band signals from frequency analysis modules 402 and 404 may be processed to determine energy level estimates during an interval of time. The energy estimate may be based on bandwidth of the sub-band channel and the acoustic signal. The energy level estimates may be determined by frequency analysis module 402 or 404, an energy estimation module (not illustrated), or another module such as feature module 406. Functionality of feature module 406 is described below with reference to FIGS. 6A and 6B.

Multi-feature cluster tracker 410 may receive level differences between energy estimates of sub-band framed signals from feature module 406. Multi-feature cluster tracker 410 may determine a global summary of acoustic features based, at least in part, on acoustic features derived from an acoustic signal, as well as an instantaneous global classification based on a global running estimate and the global summary of acoustic features. The global running estimates may be updated and an instantaneous local classification derived based on at least the one or more acoustic features. Spectral energy classifications may then be determined based, at least in part, on the instantaneous local classification and the one or more acoustic features.

In some embodiments, multi-feature cluster tracker 410 classifies points in the energy spectrum as being speech or noise based on these local clusters and observations. As such, a local binary mask for each point in the energy spectrum is identified as either speech or noise. Multi-feature cluster tracker 410 may generate a noise/speech classification signal per subband and provide the classification to NPNS 408 to control its canceller parameters adaptation. In some embodiments, the classification is a control signal indicating the differentiation between noise and speech. NPNS 408 may utilize the classification signals to estimate noise in received microphone energy estimate signals, such as $M_\alpha$, $M_\beta$, and $M_\gamma$. In some embodiments, the results of multi-feature cluster tracker 410 may be forwarded to the noise estimate module 412. Essentially, current noise estimates, along with locations in the energy spectrum where the noise may be located, are provided for processing a noise signal within audio processing system 208.

Multi-feature cluster tracker 410 uses the normalized cues from microphone M3 and either microphone M1 or M2 to control the adaptation of the NPNS 408 implemented by microphones M1 and M2 (or M1, M2, and M3). Hence, the tracked features are utilized to derive a sub-band decision mask in post filter module 414 (applied at multiplier component 416) that controls the adaption of the NPNS 408 sub-band source estimate.

Noise estimate module 412 may receive a noise/speech classification control signal and the NPNS 408 output to estimate the noise N(t,w). Multi-feature cluster tracker 410 differentiates (i.e., classifies) noise and distracters from speech and provides the results for noise processing. In some embodiments, the results may be provided to noise estimate module 412 in order to derive the noise estimate. The noise estimate determined by noise estimate module 412 is provided to post filter module 414. In some embodiments, post filter module 414 receives the noise estimate output of NPNS 408 (output of the blocking matrix) and an output of multi-feature cluster tracker 410, in which case a noise estimate module 412 is not utilized. Additional functions of multi-feature cluster tracker 410 are explained below with reference to FIGS. 6A and 6B.

Post filter module 414 receives a noise estimate from multi-feature cluster tracker 410 (or noise estimate module 412, if implemented) and the speech estimate output from NPNS 408. Post filter module 414 derives a filter estimate based on the noise estimate and speech estimate. In one embodiment, post filter module 414 implements a filter such as a Wiener filter. Alternative embodiments may contemplate other filters.

Next, the speech estimate is converted back into time domain from the sub-band domain by frequency synthesis module 418. The conversion may comprise taking the masked frequency sub-bands and adding together phase shifted signals of the sub-bands in a frequency synthesis module 418. Alternatively, the conversion may comprise taking the masked frequency sub-bands and multiplying these with an inverse frequency of the sub-band filters in the frequency synthesis module 418. Once conversion is completed, the signal is output to a user via output device 206.

Processing Examples

Figure 5:
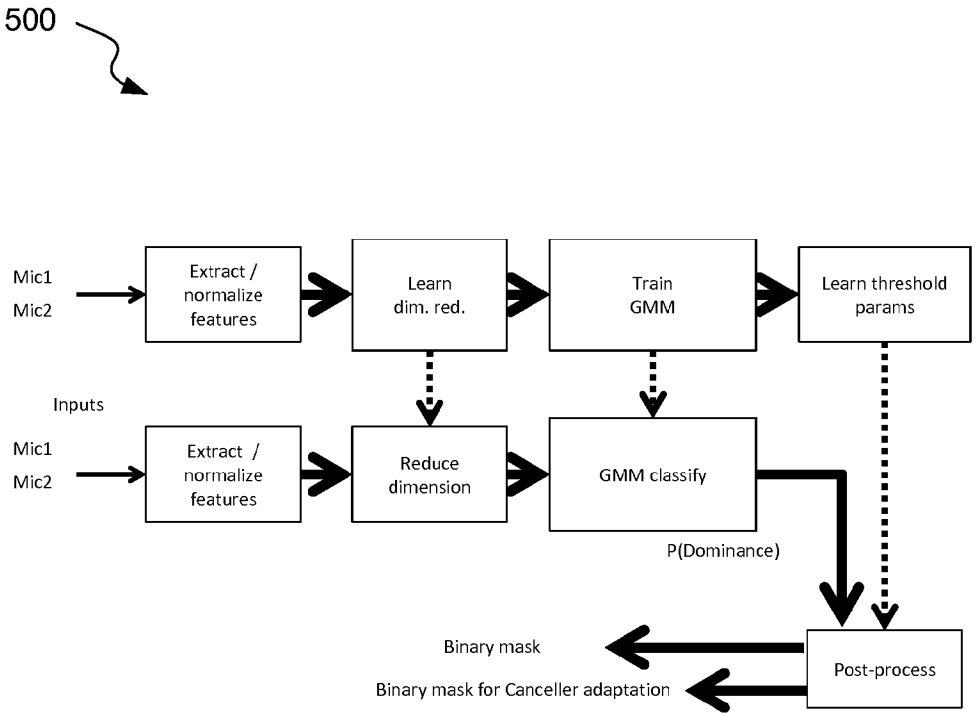
FIG. 5 illustrates a general process flowchart of operating an audio processing system, in accordance with certain embodiments.

FIG. 5 illustrates a general process flowchart 500 of operating an audio processing system, in accordance with certain embodiments. It includes both training (represented by four blocks in the top row) and operation (represented by four blocks in the second and third rows). The result of the process may be a binary mask such as a post-filter mask or canceller adaptation control mask. The training path includes receiving a training data set representing, for example, an audio input produced by multiple microphones. This input may be referred to as a training multichannel audio input corresponding to multiple audio channels. The training data set is processed to generate a spectral representation of the test multichannel audio input and extract one or more acoustic features from that spectral representation. A dimension reduction may be learned in the next operation followed by training a GMM. Furthermore, threshold parameters may be learned. These operations are further described below with reference to FIG. 6B.

The operating path (represented by four blocks in the second and third rows) includes receiving an actual data set from multiple microphones. This input needs to be processed to differentiate between the signal data and noise data. This path also includes generation of a spectral representation of the multichannel audio input. Then, multiple acoustic features are extracted from that spectral representation. A dimensionality reduction is applied by performing linear transformation of the multiple acoustic features. The process continues with classifying each time-frequency observation in the transformed data using a GMM to identify noise points and signal points in the multichannel audio input. These operations are further described below with reference to FIG. 6A.

Figure 6A:
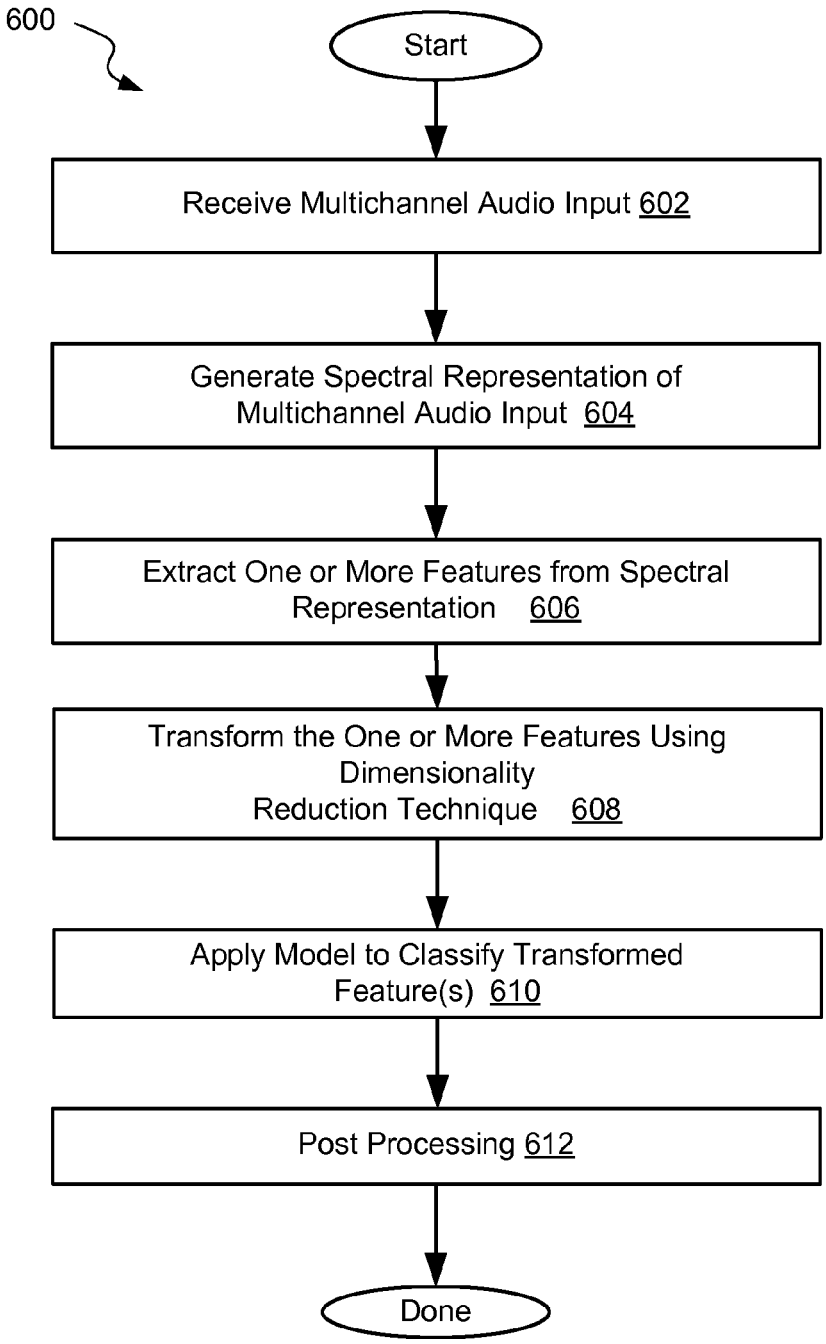
FIG. 6A illustrates a process flowchart corresponding to a method for processing acoustic signals, in accordance with certain embodiments.

Specifically, FIG. 6A illustrates a process flowchart corresponding to method 600 for processing acoustic signals, in accordance with certain embodiments. Method 600 may commence with receiving a multichannel audio input corresponding to a plurality of audio channels during operation 602, followed by generating a spectral representation of the multichannel audio input during operation 604.

Method 600 then proceeds with extracting at least one acoustic feature from the spectral representation during operation 606. In some embodiments, these acoustic features correspond to each individual channel of the plurality of audio channels. In the same or other embodiments, the acoustic features correspond to interactions between individual channels of the plurality of audio channels.

Features may be extracted using a feature collection module. The module may extract more features than actually used. These extra features may be used for feature selection tasks and for comparisons at training time. During operation, the extra features do not need to be computed, thereby saving resources.

Some examples of acoustic features include an interaural level difference, interaural phase difference, primary microphone energy, estimated pitch, and estimated pitch saliency. An ILD feature may be a normalized interaural level difference between primary and tertiary microphones, which may be the most widely separated pair of the microphones. When only two microphones are used, this feature represents the normalized interaural level difference between the primary and secondary microphones. This feature may be computed using another module. The normalization may be performed by subtracting the $10^{th}$ percentile of the global interaural level difference from the interaural level difference corresponding to a specific pair of microphones.

Another feature is IPD, which is an interaural phase difference between the primary and secondary microphones, which are the closest pair of microphones in three or more microphone configurations. Another feature may be a normalized global ILD between the primary and tertiary microphones. This is the mean of the ILD (before being normalized) weighted based on a function of the energy at the primary microphone. The normalization is achieved by subtracting the $10^{th}$ percentile of the value of the feature, as estimated by a Robbins-Monro percentile tracker. Yet another feature corresponds to a transformed value of the estimated pitch salience. The transformation may have the effect of spreading out the pitch salience values that are close to 0 and/or 1.

Method 600 then proceeds with performing a linear transformation of the one or more acoustic features using a dimensionality reduction technique to generate transformed data during operation 608.

In some embodiments, the dimensionality reduction technique involves a linear support vector machine. Performing the linear transformation may involve subtracting a data mean, whitening the data, generating a maximum margin hyperplane separating speech points from noise points in the multichannel audio input, and projecting the speech points and the noise points onto the maximum margin hyperplane. Performing the linear transformation may be repeated for each of multiple dimensions in the null space of the previous hyperplane, which may be orthogonal and decorrelated.

Method 600 then proceeds with classifying each time-frequency observation in the transformed data using a GMM to identify noise points and signal points in the multichannel audio input during operation 610. In some embodiments, a different GMM is used for each frequency band of the multichannel audio input. The noise points and signal points may be identified in the multichannel audio input based on a probability of each data point determined with the GMM. The noise points and signal points are identified by further processing the probabilities of data points determined using the GMM. This further processing may involve incorporating local contextual information.

In some embodiments, the method also involves updating the GMM based on the transformed data generated by the linear transformation and repeating classifying operations using the updated GMM. Repeating the classifying operation using the updated GMM may be performed on a new set of transformed data. Generating, extracting, performing, and classifying operations may be repeated upon receiving a new multichannel audio input to identify new noise points and new signal points. The same or different (e.g., updated) GMM may be used during the repeated classifying operation. In some embodiments, the method also involves generating a binary mask such as a post-filter mask or a canceller adaptation control mask based on the identified noise points and the identified signal points.

Adapting the GMM during operation (i.e., at runtime) will now be further described. The combined GMM may be run in an unsupervised way to update the cluster locations with the calibration GMM. This unsupervised update may use an EM algorithm, which includes an expectation step and maximization step. During the expectation step, the posterior probability of the tth point coming from the kth Gaussian in the mixture is computed using the following formula:

$$c_{kt}=\pi_k N(x_t|\mu_k,\Sigma_k).$$

This quantity is used to classify the point as either target or noise. Specifically, the classification is performed in accordance with:

$$p(\text{target}_t)=\Sigma_{k=1}^{NTclust} c_{kt}$$

where NTclust is the number of target clusters.

In the maximization step, the parameters of all of the Gaussians may be updated according to:

$$\pi_k = \frac{v_k + \Sigma_t c_{kt}}{\Sigma_{k'}(v_{k'} + \Sigma_t c_{k't})}$$

$$\mu_k = \frac{\tau_k m_k + \Sigma_t c_{kt} x_t}{\tau_k + \Sigma_t c_{kt}}$$

$$\Sigma_k = \frac{\tau_k(\mu_k - m_k)(\mu_k - m_k)^T + \Sigma_t c_{kt}(x_t - \mu_k)(x_t - \mu_k)^T}{\Sigma_t c_{kt}}$$

where the prior is specified by $m_k$, the prior mean of the kth Gaussian by $\tau_k$, the strength of the prior on the mean in units of "virtual observations," and $v_k$, the strength of the prior on the kth mixture weight in units of "virtual observations." When E is diagonal, its update reduces to:

$$\Sigma_k = \frac{\tau_k(\mu_k - m_k)^2 + \Sigma_t c_{kt}(x_t - \mu_k)^2}{\Sigma_t c_{kt}}$$

Setting $\tau_k$ and $v_k$ to 0 reduces the above maximum a posteriori updates to the normal maximum likelihood updates. Note that these priors are not on the overall GMM distribution, but on individual Gaussians themselves, so that when the prior is strong, each Gaussian component should not move too far from its corresponding Gaussian in the prior. Note also that a prior is not applied to the $\Sigma_k$ variables, however, the $\Sigma_k$ variables are affected by the prior on the $\mu_k$ variables.

In some embodiments, method 600 proceeds with post processing during operation 612. This operation may involve converting the probabilistic mask into binary masks. The probabilistic output mask of the multi-feature cluster tracker may be binarized in a post-processing stage to accommodate various processing. This post-processing also mitigates issues with the calibration of the output probabilities, which could be more useful relative to other probabilities than in their absolute values.

Different post-processing algorithms may be used for generating binary masks such as a canceller adaptation control mask, post-filter mask, and signal-to-noise estimate mask. All three may utilize Robbins-Monro percentile trackers that follow the probabilities in each tap generated by the GMMs and provide a threshold. Generally, the binary mask is on when the probabilities are above the thresholds, and off when they are below.

Figure 7A:
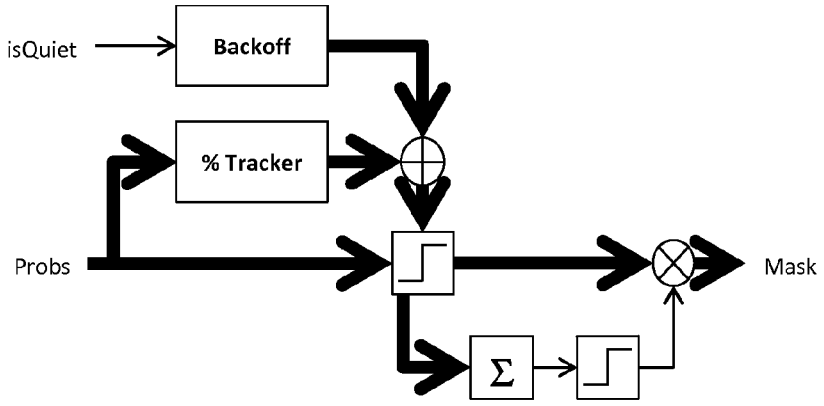
FIG. 7A illustrates a process flowchart corresponding to generating a post-filter mask, in accordance with certain embodiments.

FIG. 7A illustrates a process flowchart corresponding to generating a post-filter mask, in accordance with certain embodiments. Aside from the aforementioned percentile tracker, the process uses the isQuiet input to decide if it should back off. The isQuiet input indicates when the energy at a tap is at or below the self-noise level for that tap. Backing off, in this case, means that it lowers the threshold below what the percentile tracker requests (typically very far below it), so more points are classified as target. Back off may be removed in proportion to the amount of energy in frames where the global voice activity detection is off. In frames where the global voice activity detection is on, the back off may be held constant. Finally, a secondary voice activity detection may be applied to the thresholded probabilities, depicted here as a sum and threshold, which is described in further detail below.

Figure 7B:
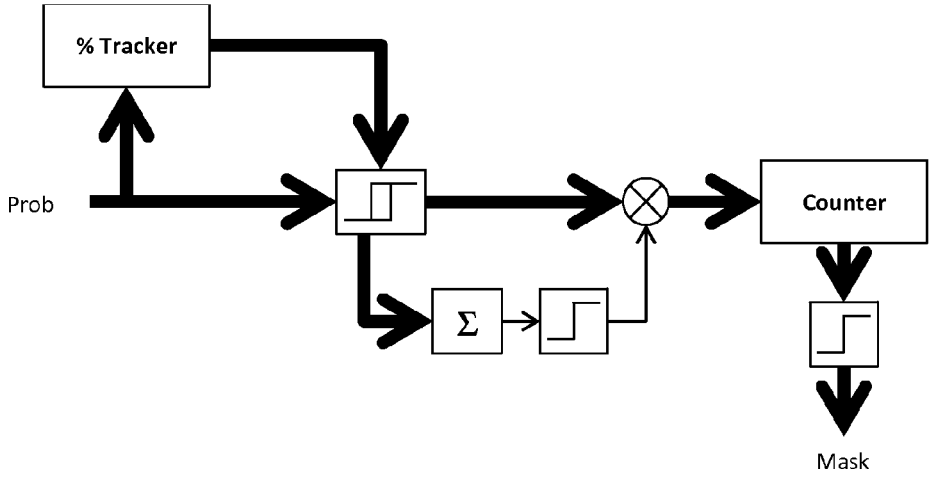
FIG. 7B illustrates a process flowchart corresponding to generating a canceller adaptation control mask, in accordance with certain embodiments.

FIG. 7B illustrates a process flowchart corresponding to generating a canceller adaptation control mask, in accordance with certain embodiments. This process may be also based around a percentile tracker, but it does not utilize a backoff mechanism. Because the canceller adaptation control signal generally needs to be sparse and conservative, there are a number of mechanisms present to prevent false positives. The first of these is the hysteresis of the thresholds. When the binary mask for a tap has been "off," the threshold for that tap gets raised above its normal value. Once that threshold has been surpassed, the threshold may be lowered for subsequent frames until that lower threshold is no longer met. In addition, there may be a counter on the output, and only taps with binary masks that have been "on" for a sufficient number of frames may actually be output as such. Additionally, there may be a secondary voice activity detection, depicted in FIG. 7B as a sum coupled to a threshold. The secondary voice activity detection will be described in further detail below.

Two voice activity detection (VAD) algorithms may be used in multi-feature cluster tracker post-processing. The global voice activity detection is derived from the probabilities in the taps at each frame. In particular for various embodiments, the global voice activity detection is a certain percentile of the probabilities at all of the taps, when they are considered together. The global voice activity detection may be calculated by sorting all of the probabilities across taps in a frame and selecting the probability in a particular position. This may produce a continuous voice activity detection value between 0 and 1, which can then be thresholded to derive a binary global voice activity detection.

Another voice activity detection algorithm (i.e., the secondary voice activity detection) may be used to discard spurious non-speech that might get through the masking process. It may be based on a harmonic sieve in a log-frequency representation. In various embodiments, first, the energies at the taps are interpolated at log-spaced frequencies. Then this log-frequency spectrum is correlated with a harmonic sieve derived from similar speech. The correlation is normalized by the L2 norm of the energy vector before the mask is applied to it, but the energy vector is correlated with the sieve after it is masked. This ensures that frames in which a lot of energy has been classified as noise will have low correlations. If the peak of the correlation is not within certain acceptable bounds of the prototype (i.e., it is too high or too low in frequency, then the secondary voice activity detection is set to 0). Otherwise, secondary voice activity detection is set to the value at the peak of the cross-correlation.

The secondary voice activity detection may then be combined with the continuous global voice activity detection using a geometric average and the result compared to the thresholds. If it is high enough, or if it was high within a holdover period, the secondary voice activity detection preserves the masks. Otherwise, in according to some embodiments, all taps in the mask may be set to 0.

Figure 6B:
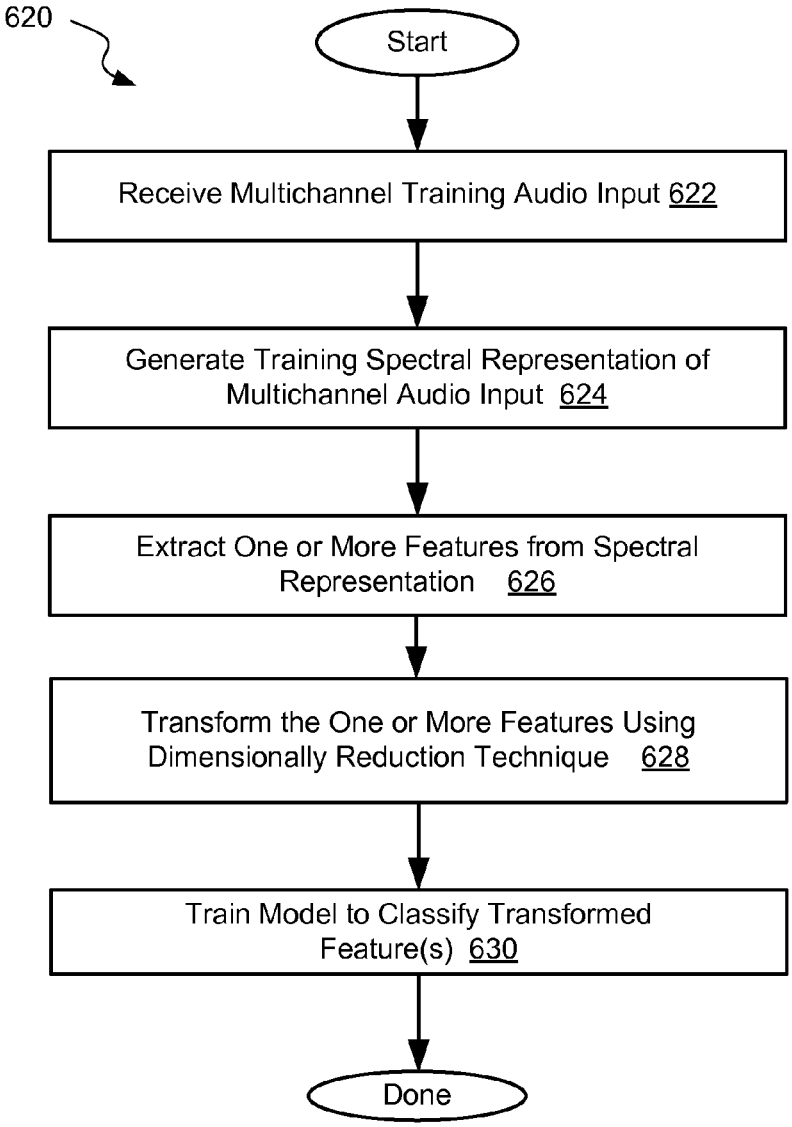
FIG. 6B illustrates a process flowchart corresponding to a method of calibrating an apparatus for processing acoustic signals, in accordance with certain embodiments.

FIG. 6B illustrates a process flowchart corresponding to method 620 of calibrating an apparatus for processing acoustic signals, in accordance with certain embodiments. In other words, method 620 is used to train various models and other components of the audio processing system. Method 620 may involve receiving a multichannel training audio input corresponding to a plurality of audio channels during operation 622 and generating a training spectral representation of the multichannel training audio input during operation 624. In some embodiments, operation 622 is skipped and one or more files are provided to the audio processing system already include a training spectral representation used for calibration.

Method 620 then proceeds with extracting one or more training acoustic features from the training spectral representation during operation 626 and performing a linear transformation of the one or more training acoustic features during operation 628. These operations may be similar to corresponding operations described above with reference to FIG. 6A. A GMM is then trained during operation 630. Training of the GMM may involve an algorithm to optimize generative costs and discriminative costs.

A GMM may be learned from labeled training data which includes ground truth target and noise signals. In order to normalize out microphone skews, the feature extraction stage uses a Robbins-Monro percentile tracker on the global interaural level difference feature or other features. It tracks the $10^{th}$ percentile of the global interaural level difference and subtracts that from all interaural level difference values (global and per-tap) as explained above. In this way, a constant interaural level difference offset, as is caused by a microphone skew, can be subtracted. In order to ensure that it only tracks long-term interaural level difference offsets, the percentile tracker may have a very long time constant which may cause sensitivity to initial conditions and adaptation schedule.

A GMM is defined by the following probability distribution function (PDF):

$$p(x|\Theta)=\Sigma_k \pi_k N(x|\mu_k,\Sigma_k)$$

where the model parameters are $\Theta=\{\pi_k, \mu_k, \Sigma_k\}_{k=1 \ldots k}$ and $N(x|\mu, \Sigma)$ is the PDF of a single Gaussian:

$$N(x \mid \mu, \Sigma) = (2\pi)^{-\frac{D}{2}} |\Sigma|^{-\frac{1}{2}} \exp\left(-\frac{1}{2}(x-\mu)^T \Sigma^{-1}(x-\mu)\right)$$

where D is the dimensionality of x. To save memory and Millions of Operations Per Second (MOPS), the multi-feature cluster tracker assumes that $\Sigma$ is diagonal, in which case $$N(x \mid \mu, \Sigma) = (2\pi)^{-\frac{D}{2}} \Pi_i \sigma_i^{-1} \exp\left(-\frac{(x_i-\mu_i)^2}{2\sigma_i^2}\right)$$

where $\sigma_i^2$ is the ith element on the diagonal of $\Sigma$.

The GMM can be trained with an online, gradient descent-based scheme that attempts to balance both generative and discriminative costs. The discriminative cost may be the most useful because the models are used to discriminate between target and noise, but the generative cost provides a regularization for the model and makes sure that the GMMs do not stray too far from the data in their quest to discriminate between the two classes. The regularization protects the model from over-fitting the training data and allows it to generalize better to unseen test data. The training procedure may also be run in an unsupervised manner at runtime.

According to various embodiments, the thresholds used to convert the probabilistic outputs into binary masks are also learned from the data. Validation utterances may be used. The trained pre-processing transformations and GMMs are used to classify every time-frequency point of every validation utterance. Because the validation utterances also have ground truth information, they may be used for feature selection and other sorts of model tuning.

The calibration that takes place on the validation set is the extraction of typical probabilities. These probabilities may be used to initialize the Robbins-Monro percentile trackers that set the binarization thresholds for each tap, and also provide a baseline from which these trackers cannot stray too far.

Computer System Examples

Figure 8:
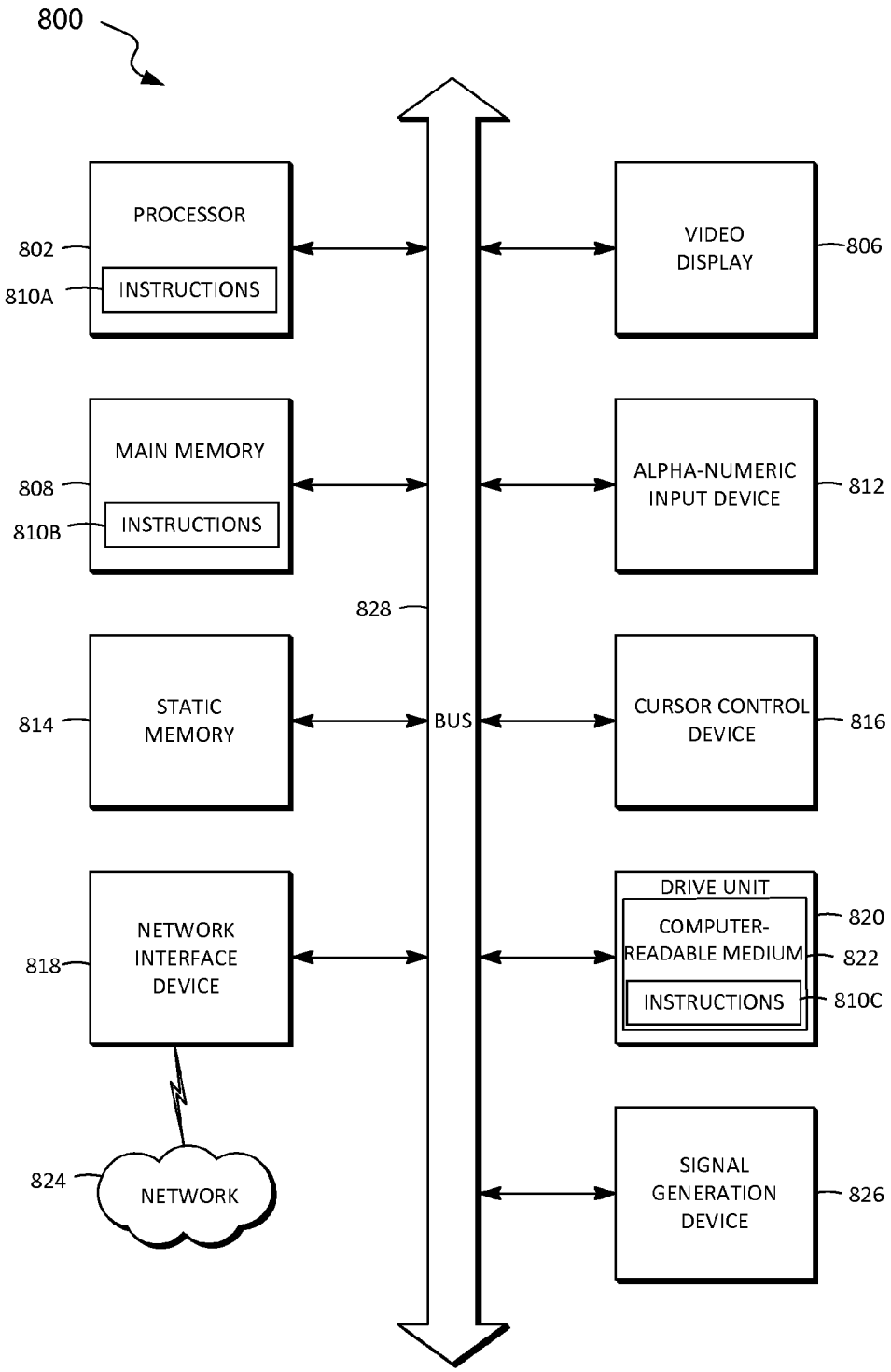
FIG. 8 is a diagrammatic representation of an example machine in the form of a computer system 800, within which a set of instructions for causing the machine to perform any one or more of the methodologies discussed herein may be executed.

FIG. 8 is a diagrammatic representation of an example machine in the form of a computer system 800, within which a set of instructions for causing the machine to perform any one or more of the methodologies discussed herein may be executed. In various example embodiments, the machine operates as a standalone device or may be connected (e.g., networked) to other machines. In a networked deployment, the machine may operate in the capacity of a server or a client machine in a server-client network environment, or as a peer machine in a peer-to-peer (or distributed) network environment. The machine may be a personal computer (PC), a tablet PC, a set-top box (STB), a Personal Digital Assistant (PDA), a cellular telephone, a portable music player (e.g., a portable hard drive audio device such as an Moving Picture Experts Group Audio Layer 3 (MP3) player), a web appliance, a network router, switch or bridge, or any machine capable of executing a set of instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein.

The example computer system 800 includes a processor or multiple processors 802 (e.g., a central processing unit (CPU), a graphics processing unit (GPU), or both), and a main memory 808 and static memory 814, which communicate with each other via a bus 828. The computer system 800 may further include a video display unit 806 (e.g., a liquid crystal display (LCD)). The computer system 800 may also include an alphanumeric input device 812 (e.g., a keyboard), a cursor control device 816 (e.g., a mouse), a voice recognition or biometric verification unit (not shown), a disk drive unit 820, a signal generation device 826 (e.g., a speaker), and a network interface device 818. The computer system 800 may further include a data encryption module (not shown) to encrypt data.

The disk drive unit 820 includes a computer-readable medium 822 on which is stored one or more sets of instructions and data structures (e.g., instructions 810) embodying or utilizing any one or more of the methodologies or functions described herein. The instructions 810 may also reside, completely or at least partially, within the main memory 808 and/or within the processors 802 during execution thereof by the computer system 800. The main memory 808 and the processors 802 may also constitute machine-readable media.

The instructions 810 may further be transmitted or received over a network 824 via the network interface device 818 utilizing any one of a number of well-known transfer protocols (e.g., Hyper Text Transfer Protocol (HTTP)).

While the computer-readable medium 822 is shown in an example embodiment to be a single medium, the term "computer-readable medium" should be taken to include a single medium or multiple media (e.g., a centralized or distributed database and/or associated caches and servers) that store the one or more sets of instructions. The term "computer-readable medium" shall also be taken to include any medium that is capable of storing, encoding, or carrying a set of instructions for execution by the machine and that causes the machine to perform any one or more of the methodologies of the present application, or that is capable of storing, encoding, or carrying data structures utilized by or associated with such a set of instructions. The term "computer-readable medium" shall accordingly be taken to include, but not be limited to, solid-state memories, optical and magnetic media, and carrier wave signals. Such media may also include, without limitation, hard disks, floppy disks, flash memory cards, digital video disks (DVDs), random access memory (RAM), read only memory (ROM), and the like.

The example embodiments described herein may be implemented in an operating environment comprising software installed on a computer, in hardware, or in a combination of software and hardware.

Although embodiments have been described with reference to specific example embodiments, it will be evident that various modifications and changes may be made to these embodiments without departing from the broader spirit and scope of the system and method described herein. Accordingly, the specification and drawings are to be regarded in an illustrative rather than a restrictive sense.

What is claimed is:

1. A method for processing acoustic signals, the method comprising:

receiving a multichannel audio input corresponding to a plurality of audio channels;

generating a spectral representation of the multichannel audio input;

extracting one or more acoustic features from the spectral representation;

performing linear transformation of the one or more acoustic features using a dimensionality reduction technique to generate transformed data; and classifying by a Gaussian mixture model (GMM) each time-frequency observation in the transformed data, the GMM providing a probabilistic mask of the transformed data, the probabilistic mask being used to identify noise points and signal points in the multichannel audio input.

2. The method of claim 1, wherein the one or more acoustic features correspond to each individual channel of the plurality of audio channels.

3. The method of claim 1, wherein the one or more acoustic features correspond to interactions between individual channels of the plurality of audio channels.

4. The method of claim 1, wherein the one or more acoustic features comprise one or more of an interaural level difference, an interaural phase difference, a primary microphone energy, an estimated pitch, and an estimated pitch saliency.

5. The method of claim 1, wherein the dimensionality reduction technique comprises a linear support vector machine and performing the linear transformation comprises subtracting a data mean, whitening the data, generating a maximum margin hyperplane separating speech points from the noise points in the multichannel audio input, and projecting the speech points and the noise points onto the maximum margin hyperplane.

6. The method of claim 5, wherein performing the linear transformation is repeated for each of multiple dimensions in the null space of a previous maximum margin hyperplane.

7. The method of claim 6, wherein the multiple dimensions are orthogonal and decorrelated.

8. The method of claim 1, wherein a different GMM is used for each frequency band of the multichannel audio input.

9. The method of claim 1, wherein the noise points and signal points are identified in the multichannel audio input based on a probability of each data point determined with the GMM.

10. The method of claim 1, wherein the noise points and signal points are identified by further processing probabilities of data points determined using the GMM, the further processing comprises incorporating local contextual information.

11. The method of claim 1, further comprising updating the GMM based on the transformed data generated by the linear transformation and repeating the classifying operation using the updated GMM.

12. The method of claim 11, wherein repeating the classifying operation using the updated GMM is performed on a new set of transformed data.

13. The method of claim 1, further comprising repeating receiving, generating, extracting, performing, and classifying operations on a new multichannel audio input to identify new noise points and new signal points.

14. The method of claim 13, wherein the original GMM is used during the repeated classifying operation.

15. The method of claim 1, further comprising generating a binary mask such as a post-filter mask or a canceller adaptation control mask based on the identified noise points and the identified signal points.

16. The method of claim 15, further comprising applying the generated mask to the acoustic signals to suppress noise.

17. The method of claim 1, wherein, prior to being used for classifying, the GMM is trained to optimize generative costs and discriminative costs.

18. The method of claim 1, wherein the GMM comprises two Gaussian mixture models (GMMs), a first GMM trained to identify the noise points in the transformed data and a second GMM trained to identify the signal points in the transformed data.

19. A method of calibrating an apparatus for processing acoustic signals, the method comprising:

receiving a multichannel training audio input corresponding to a plurality of audio channels;

generating a training spectral representation of the multichannel training audio input;

extracting one or more training acoustic features from the training spectral representation;

performing linear transformation of the one or more training acoustic features using a dimensionality reduction technique to generate a training transformed data; and training a Gaussian mixture model (GMM) based on the transformed data, the GMM configured to provide a probabilistic mask of the transformed data, the probabilistic mask being used to identify noise points and signal points in the multichannel training audio input.

20. The method of claim 19, wherein the linear transformation and GMM are selected from the plurality of linear transformations and GMMs based on a number of microphones and microphone spacing.

21. The method of claim 19, wherein training the GMM comprises an algorithm to optimize generative costs and discriminative costs.

22. An apparatus for processing acoustic signals, the apparatus comprising:

two or more microphones for receiving a multichannel audio input corresponding to two or more audio channels;

an audio processing system for generating a spectral representation of the multichannel audio input, extracting one or more acoustic features from the spectral representation, performing a linear transformation of the one or more acoustic features using a dimensionality reduction technique to generate transformed data, classifying by a Gaussian mixture model (GMM) each time-frequency observation in the transformed data to provide a probabilistic mask of the transformed data, the probabilistic mask being used to identify noise points and signal points in the multichannel audio input, developing another mask for distinguishing the noise points and the signal points, and applying the other mask to the multichannel audio input to generate a processed output.

* * * * *